United States Patent [19]

Pirotte

[11] 4,147,927

[45] Apr. 3, 1979

[54] SELF-REGULATING HEATING ELEMENT

[75] Inventor: Franz L. G. Pirotte, Brussels, Belgium

[73] Assignee: U.S. Philips Corporation, New York, N.Y.

[21] Appl. No.: 673,407

[22] Filed: Apr. 5, 1976

[30] Foreign Application Priority Data

Apr. 7, 1975 [NL] Netherlands ..... 7504083

[51] Int. Cl.[2] ..... H05B 3/02; H01C 7/02

[52] U.S. Cl. ..... 219/541; 219/241; 219/328; 219/505; 219/534; 219/537; 219/539; 219/540; 219/544; 338/22 R; 338/316; 338/328

[58] Field of Search ..... 219/209, 210, 222, 241, 219/342, 505, 506, 536, 537, 541, 530, 540, 534, 539; 338/22 R, 23, 24, 25, 28, 295, 228, 254, 255, 260, 51, 52, 59, 159, 199, 232, 233, 316, 322, 328, 329

[56] References Cited

U.S. PATENT DOCUMENTS

| | | | |
|---|---|---|---|
| 2,606,986 | 8/1952 | Sweger | 338/23 X |
| 2,958,208 | 5/1976 | Blaha | 219/505 UX |
| 3,375,774 | 4/1968 | Fujimura et al. | 219/505 UX |
| 3,719,796 | 3/1973 | Abildtrup | 219/504 X |
| 3,748,439 | 7/1973 | Ting et al. | 219/505 X |
| 3,749,879 | 7/1973 | Armstrong | 219/505 X |
| 3,835,434 | 9/1974 | Kahn | 338/22 R |
| 3,940,591 | 2/1976 | Ting | 219/505 X |
| 3,996,447 | 12/1976 | Bouffard et al. | 219/505 X |

*Primary Examiner*—A. Bartis

*Attorney, Agent, or Firm*—Frank R. Trifari; Rolf E. Schneider

[57] ABSTRACT

A self-regulating heating element comprising a tubular body closed at each end and containing two longitudinal electrically and thermally conductive flat strips arranged parallel to and spaced from each other. Each flat strip is provided along at least one longitudinal edge thereof with an abutting longitudinal resilient heat-conductive strip conforming with the adjacent surface of the inner wall of the tubular body so as to be in resilient heat-exchange contact with such inner surface for conducting heat from the flat strip to the tubular body. At least one PTC resistor is positioned between and in electrical and heat-exchange contact with the parallel flat strips, electrical terminals extending through the tubular body into contact with the flat strips. Such heating elements find particular use as immersion heaters for liquids and as the heat source in hair-curling devices.

3 Claims, 5 Drawing Figures

SELF-REGULATING HEATING ELEMENT

This invention relates to a self-regulating heating element which comprises as a heat source at least one resistor body of a material having a positive temperature coefficient of electrical resistance, also called PTC resistor hereinafter.

Such resistors usually consist of sintered barium titanate which has been doped with rare earth, antimony, columbium or other elements, or mixtures thereof with strontium titanate and/or lead titanate. The heat conductivity of such a material is relatively low and consequently also the heat dissipation in air. When loaded, the PTC resistor attains in these circumstances at a relatively low power output the temperature at which the resistance increases quickly (Curie point). A relatively small further increase in temperature then results in a relatively large increase in the resistance. This sets a limit to the power which can be consumed and which can be dissipated in the form of heat.

It is inter alia an object of the invention to improve the heat dissipation in a heating element having one or more PTC resistors as a heat source. In this manner the maximum consumable power is increased because, with an improved heat dissipation, the PTC resistors will reach the Curie point only at a larger power output. A heating element with good heat dissipation is, for example, known from U.S. Pat. No. 3,719,796. In this known heating element the PTC resistor is enclosed in a casing and the space in the casing which is not occupied by the PTC resistor is filled with a liquid.

In practice a heating element filled with a liquid has some drawbacks. The casing must be, and must remain, absolutely liquid-tight, even when the liquid tries to expand when it is heated during use of the element. This particularly entails problems of a constructional nature when the feedthrough of the current conductors in the casing is effected. Furthermore it must be prevented as much as possible that inexpert usage might cause leaks so that a hot liquid might be released.

It is an object of the present invention to provide a self-regulating heating element having one or more PTC resistors which satisfies the requirements described hereinbefore and for which the said drawbacks are avoided as much as possible.

According to the invention this requirement is satisfied by a self-regulating heating element which is characterized in that the resistor body is situated between metal bodies which, at the side facing away from the resistor body contact the inner wall of the casing in such a way that heat exchange takes place. For this purpose the metal bodies at the side facing away from the resistor body are preferably of a form which approximately corresponds with the form of the associated part of the surface of the inner wall of the casing. If the casing has an internal cylindrical space in which the metal bodies are situated with the PTC resistor between them, then the metal bodies possess in this preferred embodiment also a cylindrical shape at the side facing away from the PTC resistor. Of course all this also applies if the space in question has another form, for example a conical form. The metal bodies may then be solid or hollow and consist of metal strips provided with bent parts. Then the form and the dimensions are brought into harmony in such a manner that a maximum heat-exchanging contact is obtained. Preferably all this is done in such a way that a resilient contact is obtained between the metal bodies and the inner wall of the casing. In an advantageous embodiment of this last possibility the metal bodies consist of flat strips which, at least at an edge running in the longitudinal direction of the casing have been provided with a strip part whose form approximately corresponds with the form of the part of the surface of the inner wall of the casing which cooperates in the heat-exchanging contact. A resilient and consequently a properly abutting thermal contact is obtained by means of this last-mentioned metal strip part. Such an element may, for example, be produced by partly bending a metal strip. If the metal bodies are solid or of one piece, but hollow, the resilient contact is obtained by means of a layer of elastic, electrically insulating material which is situated on the inner wall of the casing. For this purpose, for example a layer of a silicon resin or another resin which does not soften or decompose at the operating temperature and which maintains its elastic properties may be present at the inner wall of a casing of a relatively rigid material or a tube made of such a material may be used. The resin may be mixed with a filler which improves its heat conduction, for example magnesium oxide, aluminium oxide, or metal powder.

It is clear that the resilient and heat-exchanging contact must be maintained at the operating temperature. The dimensions of the metal bodies and the properties thereof must have been brought in line with this requirement. The metal bodies may, for example, consist of aluminium or copper or an alloy of these metals with one another or other metals. The PTC resistors to be applied in the resistor elements according to the invention are preferably disc-shaped and may then have a circular, hexagonal, square, rectangular or another shape which is suitable for the purpose, in which two opposite planes are available, or they may have been constructed in the shape of a rod or tube. The end faces of the disc-shaped bodies are connected to metal bodies. For this purpose the end faces of the disc-shaped bodies have been provided with the usual electrodes, for example consisting of a vacuum-deposited layer of a nickel-chromium alloy, on which a thin vacuum-deposited layer of silver is present or they may have been obtained by another method, for example by the electroless deposition of nickel. With a baculiform body small strip-like electrodes may be applied in the longitudinal direction of the body. With tubular bodies the electrodes may be situated at the inner surface and at the outer surface. The connection may exclusively be of a heat-exchanging character for which an adhering layer of an electrically insulating synthetic material may be sufficient. Current conductors are then directly connected to the PTC resistor. Beside heat-exchanging the connection may also be electrically conducting. To this end the PTC resistor may be connected to one or both metal bodies by means of soldering or by means of an electrically conducting paste thus forming an ohmic contact. In this case one or both bodies function as a current conductor. An electrically conducting paste which is suitable for this purpose may, for example, consist of a hardenable silicone resin-silver powder mixture. These pastes are known per se and are a normal trade article.

Of course various PTC resistors may be located between the metal bodies in the described manner.

In an embodiment of the self-regulating heating element which has the advantage that an adjustment to various temperatures is possible, PTC resistors are used which have mutually different Curie points. In this connection the Curie point must be understood to mean that point at which a change in the crystal structure, coupled with a sudden increase in the resistance, occurs. By switching the voltage source from one to the other PTC resistor the mutually different temperatures can be adjusted. Such an element comprises at least two PTC resistors having different Curie points, which can be independently connected to a voltage source through current conductors; at least one of the PTC resistors is connected to one of the metal bodies by means of a layer of electrically insulating material and may be connected to a voltage source through a respective current conductor. The casing may, for example, be cylindrical, whilst at least the inner wall may consist of an inorganic or organic electrically insulating material or may have been coated. For this purpose, for example a non-electrically conducting material may be used such as a quartz glass, silicone rubber or ceramic material which is form-retaining at the highest operating temperature of the element. The casing may be of a laminated construction of at least an electrically insulating layer which is situated within a metal cover. Such a metal cover, for example in the form of a casing of, for example, copper ensures a proper axial heat transport. It is possible to fill the free space with an electrically insulating material such as, for example, pulverulent aluminium oxide or magnesium oxide, or a synthetic resin such as a silicone rubber. The electrical contact between the PTC resistors and the metal bodies may be obtained by soldering or by means of an electrically conducting paste, for example a mixture of a silicone resin and a metal powder, such as silver powder.

Reference is now made to accompanying drawing showing some embodiments of a heating element according to the invention, in which.

Figure 1:
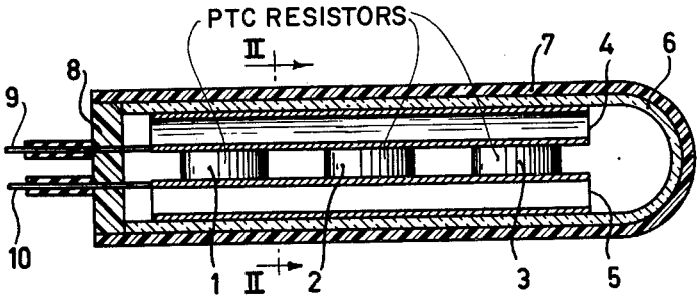
FIG. 1 shows a longitudinal section of a self-regulating heating element according to the invention.

The embodiment of a self-regulating heating element shown in FIG. 1 comprises three disc-shaped PTC resistors 1, 2 and 3, which are situated between two metal bodies 4 and 5 and which are connected therewith in such a way that a heat-exchanging contact and an electrical conduction are obtained. The connection between the PTC resistors 1, 2 and 3 and the metal bodies 4 and 5 may consist of a layer of solder. The assembly is situated within a casing, consisting of a tube 6, made of an inorganic material, preferably hard glass, which is closed at one end, and which in itself is placed in a metal or synthetic resin tube 7, which is closed at one end. If desired a layer of electrically insulating material may be present between the tube parts 6 and 7. If the latter tube parts consist of a metal, this material may have been applied to dipping, spraying, or casting or may consist of a shrinkage sleeve (not shown), preferably of an elastic synthetic material such as a silicone rubber filled with magnesium oxide. Tube part 7 is closed with seal 8, for example consisting of a silicone rubber, which optionally may form one assembly with tube part 7, if the latter is also made of a silicone rubber, for example by extrusion. The current conductors 9 and 10 are led out through the seal 8 and within the element these conductors are connected to the metal bodies 4 and 5 respectively. In the embodiment shown tube 6 is closed at one end. It is also possible to use a tube which is open at both ends and to close these two ends with respective seals such as the seal 8 shown in the drawing. It is also possible to seal the tube off at the ends, if it consists of glass or quartz.

Figure 2:
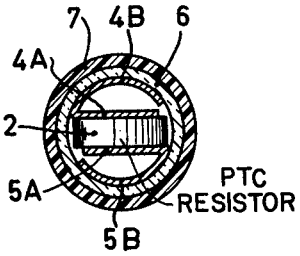
FIG. 2 shows a cross-section taken along line II—II in FIG. 1 of such an element.

The reference numerals in FIG. 2 have the same meaning as in FIG. 1. The form of the metal bodies 4 and 5 is clearly recognizable. They consist of flat strips 4A and 5A respectively and cylindrically bent parts 4B and 5B respectively. The flat strips 4A and 5A are connected to the PTC resistors; the bent parts 4B and 5B, which have a form which approximately corresponds with the form of the wall part of tube part 6, contact the wall of the tube part 6 in a resilient way and are in heat-exchanging contact therewith. If desired, to improve this contact a thin layer of a paste consisting of a silicone resin, possibly mixed with a metal powder or a suitably conducting metal oxide may be applied between the bent parts 4B and 5B and the wall of the tube part 6.

Figure 3:
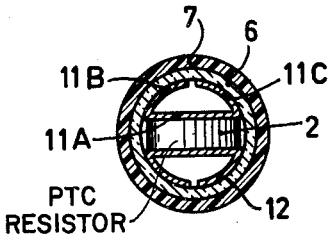
FIG. 3 shows a cross-section of another embodiment of a self-regulating heating element according to the invention.

FIG. 3 shows a metal body consisting of a flat strip part 11A which is provided with bent parts (11B and 11C respectively) extending in the longitudinal direction of the tube part 6, which parts 11B and 11C contact the inner wall of the tube part 6 in a resilient and heat-exchanging way. The body 12 has the same form as the body 11A, B, C.

Figure 4:
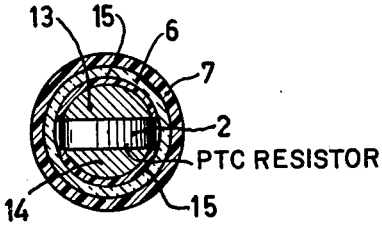
FIG. 4 shows a cross-section of a third embodiment of a self-regulating heating element according to the invention.

FIG. 4 shows solid metal bodies 13 and 14. In order to obtain a resilient contact with respect to the tube part 6, an elastic layer 15, consisting of a silicone rubber, is applied thereon between bodies 13 and 14 and the inner surface of tube part 6.

Figure 5:
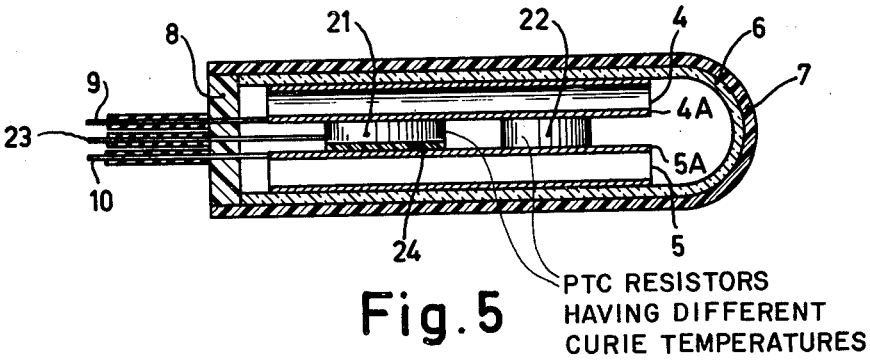
FIG. 5 shows a longitudinal section of an embodiment of a self-regulating heating element according to the invention which can be adjusted to either of two different temperatures.

The self-regulating heating element according to FIG. 5 can be adjusted to either of two temperatures. For this purpose the element is provided with two PTC resistors 21 and 22 which are located between the metal bodies 4 and 5. The metal bodies 4 and 5 have a form as shown in cross-section in FIG. 2.

The PTC resistor 22 is connected electro-conductively to the metal bodies 4 and 5, the PTC resistor 21 is connected electro-conductively to the metal body 4 only. Between the PTC resistor 21 and the flat part 5A of the metal body 5 there is an electrically non-conducting layer 24, for example consisting of an electrically non-conductive synthetic material, ceramic material or glass. Furthermore the PTC resistor is electrically connected to a current conductor 23. Current conductors 9 and 10 are connected to the metal bodies 4 and 5 respectively. The remaining reference numerals have the same meaning as in the preceding Figures. If for the self-regulating heating element the current conductors 9 and 10 are connected to a voltage source, a current will start flowing through the metal bodies 4 and 5 through the PTC resistor 22, due to which current the heating element will assume a given temperature depending on the Curie point of the material from which the PTC resistor 22 has been produced. If thereafter the current conductor 23, instead of the current conductor 10, is connected to the voltage source an electric current will then start flowing through the current conductors 9 and 23 and the metal body 4 through the PTC resistor 21. The heating element will now assume another temperature which depends on the Curie point of the material from which the PTC resistor 21 has been produced.

In a practical embodiment of a heating element according to the invention having construction as shown in FIG. 1 in longitudinal section and in FIG. 2 in cross-section the tube part 6 consisted of Pyrex glass and the tube part 7 of a silicone rubber. If this assembly was placed in a properly fitting metal tube then no temperature differences larger than 10° C. could be measured at the surface thereof. A 220 V alternating current (50 Hz) was fed to the elements. At a temperature of approximately 200° C. of the PTC resistors and an outside temperature (with metal outer tube) of approximately 175° C. no damage of the PTC resistors or a real change in the resistance value (<5%) was found at 6000 switching operations in which the element was switched on for one minute (220 V) and switched off for six minutes. In this version a heating element having three PTC resistors has a current carrying capacity of approximately 14 watts, in air the same three PTC resistors together have a current-carrying capacity which does not exceed approximately 4 watts. A self-regulating heating element according to the invention may be applied in immersion heaters for heating liquids, in hair curling devices, hot plates etc. The heating element according to the invention has in particular the advantage of being highly reliable whilst constructionally relatively simple.

Another advantage is that, with substantially the same construction, heating elements of various maximum temperatures can be obtained by building in PTC resistors having different Curie points. A further advantage is that heating elements of different temperature levels can be obtained by building two or more PTC resistors of a different Curie point into the element. Different temperature levels can also be obtained by connecting one, two, or more resistors to the voltage source for an element having two or more PTC resistors with the same Curie point.

What is claimed is:

1. A self-supporting, self-regulating heating element, which comprises a longitudinally arranged tubular body closed at each end, two longitudinal electrically and thermally conductive flat strips positioned in said tubular body parallel to and spaced from each other, each of said flat strips being provided along at least one longitudinal edge thereof with an abutting longitudinal resilient heat-conducting strip formed to conform with the adjacent surface of the inner wall of said tubular body so as to be in resilient heat-exchange contact with said adjacent inner surface for conducting heat from said flat strip to said tubular body, at least one PTC resistor between and in electrical and heat-exchange contact with said parallel flat strips, and electrical terminals extending through said tubular body in contact with said flat strips.

2. A self-regulating heating element according to claim 1, in which each of said at least one resistor is disc-shaped with the ends thereof in contact with the flat strips.

3. A self-regulating heating element according to claim 1, in which the tubular body is cylindrical in shape.

* * * * *